US010723590B2

(12) United States Patent
Qi et al.

(10) Patent No.: US 10,723,590 B2
(45) Date of Patent: Jul. 28, 2020

(54) DEVICE AND METHOD FOR DETECTING COMPRESSION AND REPOSITION PERFORMANCE OF HYDRAULIC BUFFER FOR ELEVATOR

(71) Applicants: Zhuhai Branch, Guangdong Institute of Special Equipment Inspection and Research, Zhuhai (CN); Shunde Branch, Guangdong Institute of Special Equipment Inspection and Research, Foshan (CN); Zhuhai ANYES Technology Co., Ltd., Zhuhai (CN)

(72) Inventors: Zhengwu Qi, Zhuhai (CN); Minjian Liang, Zhuhai (CN); Yuesheng Li, Zhuhai (CN); Yinghong Chen, Zhuhai (CN); Jiansheng Zeng, Zhuhai (CN)

(73) Assignees: Zhuhai Branch, Guangdong Institute of Special Equipment Inspection and Research, Zhuhai (CN); Shunde Branch, Guangdong Institute of Special Equipment Inspection and Research, Foshan (CN); Zhuhai ANYES Technology Co., Ltd., Zhuhai (CN)

( * ) Notice: Subject to any disclaimer, the term of this patent is extended or adjusted under 35 U.S.C. 154(b) by 394 days.

(21) Appl. No.: 15/692,722

(22) Filed: Aug. 31, 2017

(65) Prior Publication Data

US 2018/0099841 A1 Apr. 12, 2018

(30) Foreign Application Priority Data

Oct. 9, 2016 (CN) ..... 2016 1 0885699

(51) Int. Cl.
*B66B 5/28* (2006.01)
*B66B 5/00* (2006.01)

(52) U.S. Cl.
CPC ..... *B66B 5/288* (2013.01); *B66B 5/005* (2013.01); *B66B 5/0018* (2013.01); *B66B 5/0093* (2013.01); *B66B 5/0037* (2013.01)

(58) Field of Classification Search
CPC ..... B66B 5/288; B66B 5/0093; B66B 5/0018; B66B 5/005; B66B 5/0037
(Continued)

(56) References Cited

U.S. PATENT DOCUMENTS 6,079,521 A * 6/2000 Schonauer ..... B66B 1/3492 187/393
2003/0217895 A1* 11/2003 Kigawa ..... B66B 5/282 187/344

(Continued)

*Primary Examiner* — Jeffrey Donels
(74) *Attorney, Agent, or Firm* — M&B IP Analysts, LLC

(57) ABSTRACT

Disclosed are a device and a method for detecting compression and reposition performance of a hydraulic buffer for an elevator. The device includes a laser displacement sensor, a battery charge and power supply circuit and a controller, where the laser displacement sensor is connected to the controller through a signal conditioning and acquisition circuit and a laser emission control circuit; and where the controller is also connected to a memory and a configuration screen, respectively. It can realize the automation of multi-parameter measurement functions of a buffer, such as compression stroke measurement, reposition time measurement and reposition process monitoring (which can reflect whether the reposition process is jammed), and has a high measurement accuracy.

6 Claims, 3 Drawing Sheets

(58) Field of Classification Search
USPC ..... 187/393
See application file for complete search history.

(56) References Cited

U.S. PATENT DOCUMENTS

| | | | | |
|---|---|---|---|---|
| 2007/0246305 | A1* | 10/2007 | Roussel | B66B 1/34 187/317 |
| 2010/0133046 | A1* | 6/2010 | Allwardt | B66B 7/08 187/251 |
| 2017/0349400 | A1* | 12/2017 | Bitzi | G06T 7/70 |
| 2018/0172718 | A1* | 6/2018 | Lincoln | G01P 3/36 |

* cited by examiner

DEVICE AND METHOD FOR DETECTING COMPRESSION AND REPOSITION PERFORMANCE OF HYDRAULIC BUFFER FOR ELEVATOR

CROSS-REFERENCE TO RELATED APPLICATIONS

This application claims priority under 35 U.S.C. 119 to the Chinese Application No. 201610885699.3, filed Oct. 9, 2016, now pending.

FIELD OF THE INVENTION

The present disclosure relates to the field of elevators, and in particular to a device and method for detecting compression and reposition performance of a hydraulic buffer for an elevator.

BACKGROUND OF THE INVENTION

As a safety component of great importance for elevators, buffers for elevators are generally arranged at the bottom of a stroke of an elevator cage and a counterweight device. When an elevator goes beyond the bottom floor or the top floor, the cage or counterweight hits against the buffer which absorbs or consumes the kinetic energy of the elevator, such that the cage or counterweight is slowed down safely until stops. The buffers for elevators are divided in two main forms: energy storage buffers and energy dissipation buffers (also called hydraulic buffers). The energy storage buffers are only suitable for elevators with speed below 1 m/s, while the hydraulic buffers are suitable for any type of elevators. In addition, under the same usage conditions, the stroke required by the hydraulic buffers is half that of the spring buffers, so that the personal and equipment are better protected during operation of the evaluator. Hence, passenger elevators generally use hydraulic buffers. Hidden risks can be found in advance through routine maintenance and detection of buffers, thus ensuring the reliable operation of hydraulic buffers, which is crucial to the safety of elevators.

The safety performance of the hydraulic buffers will be influenced by various factors such as the length of compression stroke, the reposition time and whether jamming occurs during reposition. It is required in the Regulation for Lift Supervisory Inspection and Periodical Inspection—Traction and Positive Drive Lift (TSG7001-2009) that before an elevator is put into use after installation, an inspection and detection mechanism for special equipment should be used to perform confirmatory supervision and inspection to the working conditions of the hydraulic buffers; and that the maximum time limit for the complete reposition of the hydraulic buffers is 120 s (the reposition time is a time measured from the lifting of the cage to the reposition of the buffer to an original state after the buffer is completely compressed). At present, during the detection of the reposition time of a buffer for an elevator, if a person observes the timing in a pit which has a poor environment and is also dangerous, the visual inspection and manual timing are subjective. Considering the personal safety of the inspector, if the inspector monitors the compression of the cage (counterweight) to the buffer outside the cage or in a machine room, and then times the reposition process of the buffer, it is more difficult to accurately judge when the case is lifted, when the buffer repositions to the original state, and how long the actual compression stroke of the buffer is.

Conventional ways for measuring the reposition of a hydraulic buffer still depend on manual operation. Dynamic characteristics of "complete compression" and "the moment when the cage is lifted" required by the regulation can only be determined subjectively, thus no quick, reliable and accurate measurement of related data can be carried out, resulting in various problems such as large human factors in the measurement of the reposition time of the buffer, low measurement accuracy, high dispersion of results, and low detection efficiency. Due to the problems of large measurement difficulty and low measurement accuracy, the detection fails to reflect the safety performance of the buffer timely and comprehensively and thus cannot effectively ensure the safe operation of the elevators. Besides, if the inspector does not squat in a pit (it is very dangerous for the inspector to squat in the pit to make observations when the buffer is completely compressed), the inspector is unable to measure the actual compression stroke of the buffer, and thus unable to know whether jamming occurs during compression and reposition of the buffer.

SUMMARY OF THE INVENTION

To overcome the above-mentioned deficiencies in the prior art, the present disclosure provides a device and a method having high measurement accuracy for detecting compression and reposition performance of a hydraulic buffer for an elevator.

To solve technical problems, the current embodiment employs the following technical solutions.

A device for detecting compression and reposition performance of a hydraulic buffer for an elevator is provided, including a laser displacement sensor, a battery charge and power supply circuit, and a controller, wherein:

- the laser displacement sensor is connected to the controller through a signal conditioning and acquisition circuit and a laser emission control circuit, and the controller is also connected to a memory and a configuration screen, respectively;
- the laser displacement sensor is configured to transmit and receive a laser beam to measure a change in distance between a reflector on the top of the hydraulic buffer for the elevator and the laser displacement sensor;
- the laser emission control circuit is configured to control the on and off of the laser displacement sensor;
- the signal conditioning and acquisition circuit is configured to perform amplification, filtering, impedance matching and A/D conversion to a signal output from the laser displacement sensor, and then transmit the signal to the controller;
- the controller is configured to control the laser emission control circuit to acquire, store and calculate data from the signal conditioning and acquisition circuit;
- the memory is configured to store the detected data and system parameters; and
- the configuration screen is configured to transmit an operation of an operator to the controller in the form of a command, and receive the data transmitted by the controller for displaying.

Further, the signal conditioning and acquisition circuit includes a signal amplifier, a filter, an A/D convertor and a logic gate chip connected to the A/D convertor; the logic gate chip and the A/D convertor are connected to the controller, respectively; an input terminal of the signal amplifier is connected to the laser displacement sensor, while an output terminal thereof is connected to the filter; and, an outer terminal of the filter is connected to the A/D convertor.

Further, the signal conditioning and acquisition circuit further includes a resistor R1, a resistor R2, an adjustable resistor R3 and an adjustable resistor R4; two fixed terminals of the adjustable resistor R3 are connected to the anode and cathode of a power source, while an adjustment terminal thereof is connected to the resistors R1 and R2 in series; and, a fixed terminal of the adjustable resistor R4 is connected to a logic power supply input pin of the A/D convertor, the other fixed terminal thereof is connected to a reference voltage output pin of the A/D convertor, and an adjustment terminal thereof is connected to a reference voltage input pin of the A/D convertor.

A method for detecting compression and reposition performance of a hydraulic buffer for an elevator is provided, including the following steps of:

1) adhering a reflector onto the top of a hydraulic buffer for an elevator, placing a detection device at a position close to the hydraulic buffer for the elevator;
2) activating the detection device, and adjusting the position of the detection device to allow a laser beam emitted by a laser displacement sensor to be aligned with a center line of the reflector;
3) allowing the controller to acquire an initial distance X1 from the laser sensor to the reflector;
4) short-circuiting electrical switches of a lower limit position, a lower limit and a buffer of the elevator, allowing an elevator cage to run downward in a maintenance manner until the cage stops moving or a wire rope of the elevator slips on a traction wheel, and allowing the cage to move upward to the lowest floor;
5) allowing the controller to acquire in real time, at equal sampling intervals, a distance X from the laser sensor to the reflector, such that, if |X-X1|>3 mm has been detected for at least three times and compression_flag=1, then indicating that the hydraulic buffer for the elevator has been compressed, and controlling the memory starts to continuously store data; and if X-X1|<3 mm has been detected by the controller for at least three times and reposition_flag=1, then indicating that the hydraulic buffer for the elevator has repositioned completely, stopping the recording of data, and marking the distance value in the last frame of data as X4;
6) allowing the controller to process the data already stored in the step 5), searching the minimum distance X2 from the data, and recording X1-X2 as a maximum compression stroke of the buffer;
7) allowing the controller to perform calculation from the minimum distance X in the data to the last frame of data, and recording a first slope abrupt-change point in the data as X3, where the moment corresponding to the X3 is a moment point when the buffer begins to reposition; and
8) calculating a reposition time T of the hydraulic buffer for the elevator according to the following formula: T=(a time number corresponding to X4−a time number corresponding to X3)*the sampling interval.

As a further improvement of the solution, each frame of data in the steps 1)-8) includes distance data and time number data.

As a further improvement of the solution, in the step 5), when |X-X1|>3 mm has been detected for three successive times and compression_flag=1, it is indicated that the hydraulic buffer for the elevator has been compressed, and the memory starts to continuously store data; and, when |X-X1|<3 mm has been detected by the controller for three successive times and reposition_flag=1, it is indicated that the hydraulic buffer for the elevator has repositioned completely, and the recording of the data is stopped.

The current embodiment has the following beneficial effects:

the device and method for detecting compression and reposition performance of a hydraulic buffer for an elevator provided by the current embodiment can realize the automation of multi-parameter measurement functions of a buffer, such as compression stroke measurement, reposition time measurement and reposition process monitoring (which can reflect whether the reposition process is jammed), and have a high measurement accuracy. The current embodiment can properly solve the problems of low efficiency, large subjective error and incomplete detection in the existing detection of hydraulic buffers for elevators, and can improve the detection efficiency and accuracy, so that it helps in finding hidden risks.

BRIEF DESCRIPTION OF THE DRAWINGS

Features of the present disclosure will become more apparent from the following detailed description of specific embodiments, with reference to the accompanying drawings, in which.

DETAILED DESCRIPTION OF THE EMBODIMENTS

Figure 1:
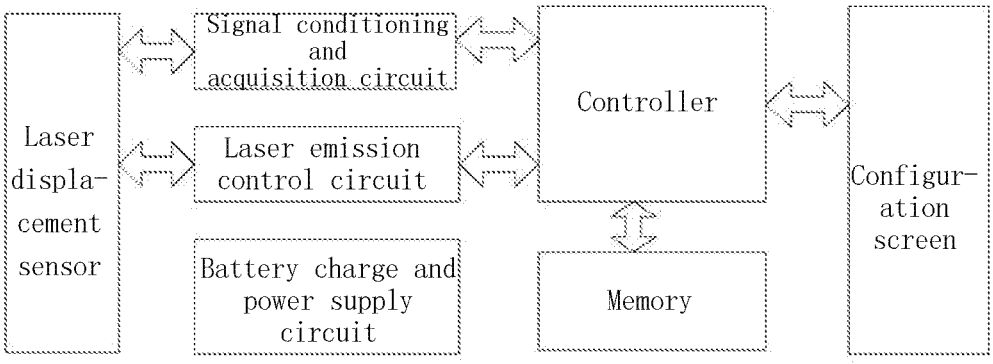
FIG. 1 is a circuit block diagram according to an embodiment.
Figure 2:
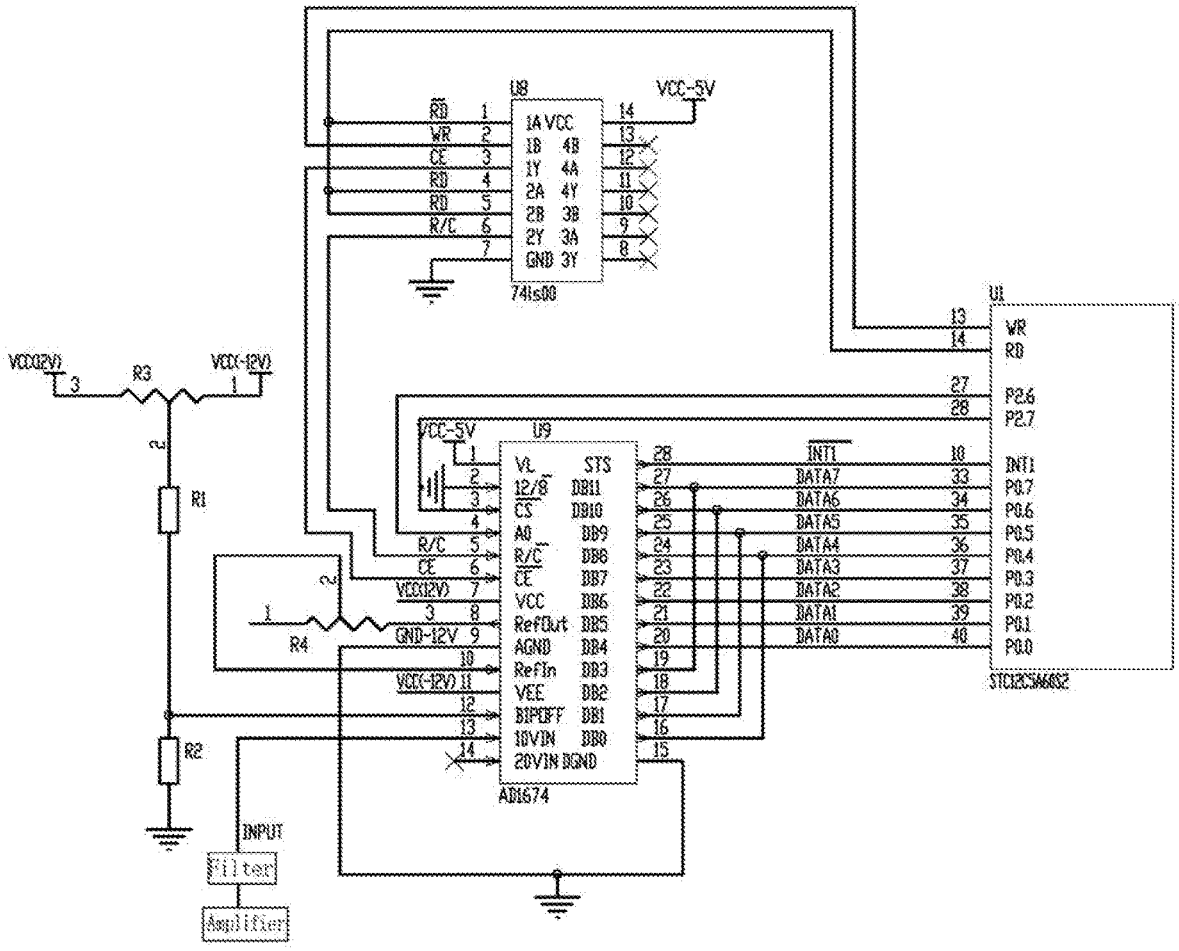
FIG. 2 is a principle diagram of a signal conditioning and acquisition circuit according to an embodiment.

Referring to FIGS. 1 and 2, a device for detecting compression and reposition performance of a hydraulic buffer for an elevator is provided. The device includes a laser displacement sensor, a battery charge and power supply circuit, and a controller, wherein the laser displacement sensor is connected to the controller through a signal conditioning and acquisition circuit and a laser emission control circuit, and the controller is also connected to a memory and a configuration screen, respectively.

In an embodiment, the laser displacement sensor is configured to transmit and receive a laser beam to measure a change in distance between a reflector on the top of a hydraulic buffer for an elevator and the laser displacement sensor.

In an embodiment, the laser emission control circuit is configured to control the on and off of the laser displacement sensor.

In an embodiment, the signal conditioning and acquisition circuit is configured to perform amplification, filtering, impedance matching and A/D conversion to a signal output from the laser displacement sensor, and then transmit the signal to the controller.

In an embodiment, the controller is configured to control the laser emission control circuit to acquire, store and calculate data from the signal conditioning and acquisition circuit.

In an embodiment, the memory is configured to store the detected data and system parameters.

In an embodiment, the configuration screen is configured to transmit an operation of an operator to the controller in the form of a command, and receive the data transmitted by the controller for displaying.

In a particular embodiment, the signal conditioning and acquisition circuit includes a signal amplifier, a filter, an A/D convertor and a logic gate chip connected to the A/D convertor; the logic gate chip and the A/D convertor are connected to the controller, respectively. An input terminal of the signal amplifier is connected to the laser displacement sensor, while an output terminal thereof is connected to the filter. An outer terminal of the filter is connected to the A/D convertor. The signal conditioning and acquisition circuit further includes a resistor R1, a resistor R2, an adjustable resistor R3 and an adjustable resistor R4. Two fixed terminals of the adjustable resistor R3 are connected to the anode and cathode of a power source, while an adjustment terminal thereof is connected to the resistors R1 and R2 in series. A fixed terminal of the adjustable resistor R4 is connected to a logic power supply input pin of the A/D convertor, the other fixed terminal thereof is connected to a reference voltage output pin of the A/D convertor, and an adjustment terminal thereof is connected to a reference voltage input pin of the A/D convertor. The adjustable resistor R3 is configured to adjust an offset of the A/D convertor, and the adjustable resistor R4 is configured to adjust the reference voltage of the A/D convertor.

In a preferred embodiment, the controller uses an STC12C5A60S2 chip, the A/D convertor is a 12-bit AD conversion chip AD1674, and the logic gate chip is 74ls00. The 0-10V analog signal output from the laser displacement sensor is filtered by the signal conditioning and acquisition circuit, and then transmitted to the AD convertor as an INPUT signal. The A/D convertor performs A/D conversion on the INPUT signal under the control of the controller, and the logic chip performs logic processing on a read/write signal of the controller U1 to adapt to a read/write sequence of the A/D convertor. At the end of each acquisition, the A/D convertor will transmit an interrupt request to the controller via an STS pin, and the controller reads a result of acquisition from the A/D convertor by an interrupt service program. In this case, the A/D convertor outputs the data to the controller through data ports DB0 to DB11. The data is transmitted at two times. High 8 bits are transmitted at the first time, and low 4 bits are transmitted at the second time.

Figure 3:
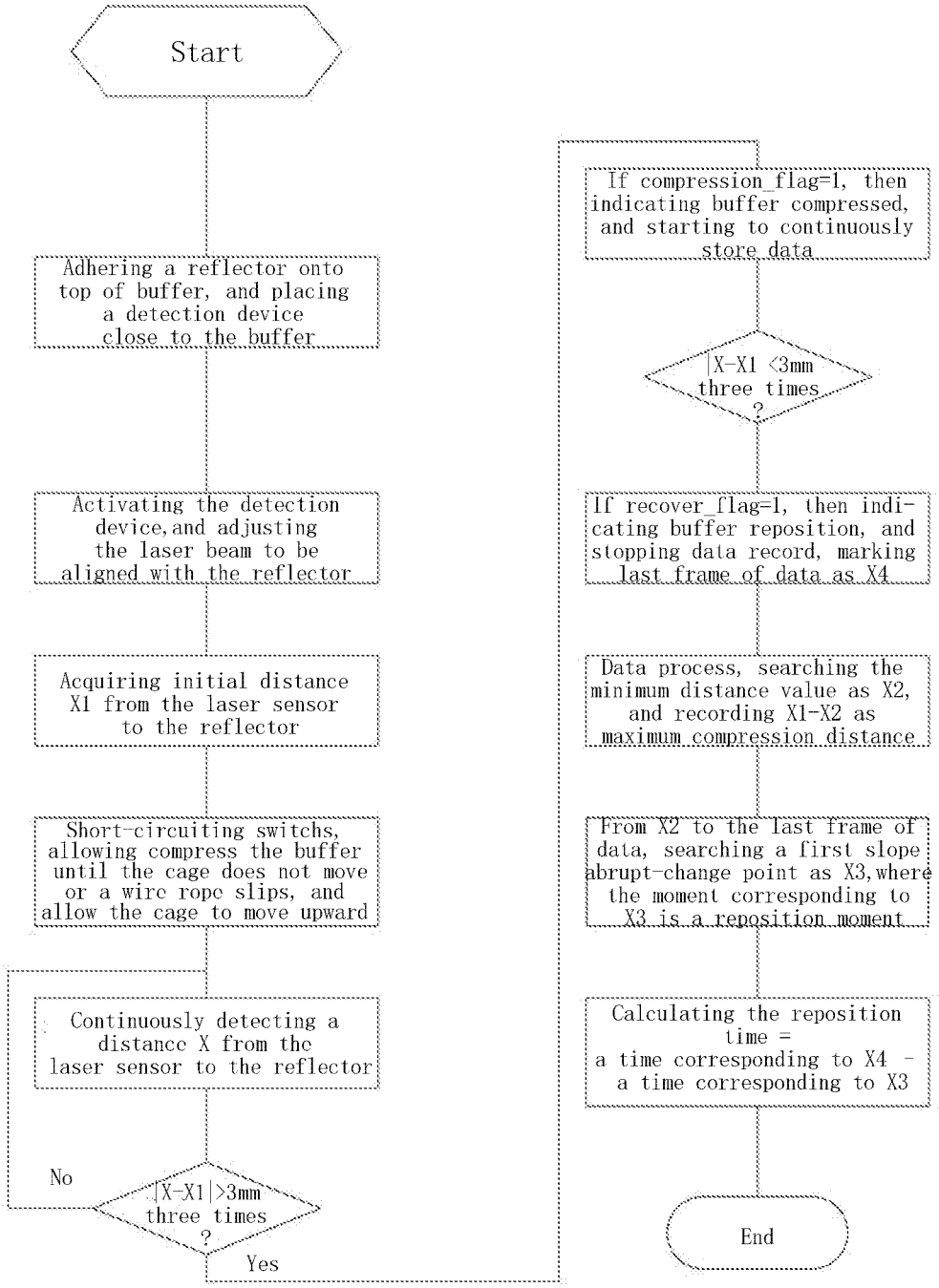
FIG. 3 illustrates a flowchart according to an embodiment.

Further, referring to FIG. 3, a method for detecting compression and reposition performance of a hydraulic buffer for an elevator is provided, specifically including the following steps of:

1) adhering a reflector onto the top of a hydraulic buffer for an elevator, placing a detection device at a position close to the hydraulic buffer for the elevator;
2) activating the detection device, and adjusting the position of the detection device to allow a laser beam emitted by a laser displacement sensor to be aligned with a center line of the reflector;
3) allowing the controller to acquire an initial distance X1 from the laser sensor to the reflector;
4) short-circuiting electrical switches of a lower limit position, a lower limit and a buffer of the elevator, allowing an elevator cage to run downward in a maintenance manner until the cage stops moving or a wire rope of the elevator slips on a traction wheel, and allowing the cage to move upward to the lowest floor;
5) allowing the controller to acquire in real time, at equal sampling intervals, a distance X from the laser sensor to the reflector, such that, if |X-X1|>3 mm has been detected for at least three times and compression_flag=1, then indicating that the hydraulic buffer for the elevator has been compressed, and controlling the memory starts to continuously store data; and if |X-X1|<3 mm has been detected by the controller for at least three times and reposition_flag=1, then indicating that the hydraulic buffer for the elevator has repositioned completely, stopping the recording of data, and marking the distance value in the last frame of data as X4;
6) allowing the controller to process the data already stored in the step 5), searching the minimum distance X2 from the data, and recording X1-X2 as a maximum compression stroke of the buffer;
7) allowing the controller to perform calculation from the minimum distance X in the data to the last frame of data, and recording a first slope abrupt-change point in the data as X3, where the moment corresponding to the X3 is a moment point when the buffer begins to reposition; and
8) calculating a reposition time T of the hydraulic buffer for the elevator according to the following formula: T=(a time number corresponding to X4−a time number corresponding to X3)*the sampling interval.

As a further improvement of the solution, each frame of data in the steps 1)-8) includes distance data and time number data.

In the current embodiment, preferably, in the step 5), the detection system continuously acquires the distance X from the laser sensor to the reflector (at constant sampling intervals). When |X-X1|>3 mm has been detected for three successive times and compression_flag=1, it is indicated that the hydraulic buffer for the elevator has been compressed, and the memory starts to continuously store data (each frame of data includes distance data and time number data). When |X-X1|<3 mm has been detected by the controller for three successive times and reposition_flag=1, it is indicated that the hydraulic buffer for the elevator has repositioned completely, the recording of the data is stopped, and the value of the distance in the last frame of data is recorded as X4.

The foregoing description merely shows the preferred embodiments of the present disclosure, and the present disclosure is not limited thereto. All technical effects of the current embodiment obtained by any identical or similar means shall fall into the protection scope of the present disclosure.

What is claimed is:

1. A device for detecting compression and reposition performance of a hydraulic buffer for an elevator, the device comprising:

a laser displacement sensor configured to transmit and receive a laser beam, wherein the laser displacement sensor is configured to measure, based on the laser beam, a change in distance between a reflector disposed on a hydraulic buffer and the laser displacement sensor;

a battery charge connected to a power supply circuit;

a signal conditioning and acquisition circuit configured to performing at least one of: amplification, filtering, impedance matching, and analog to digital conversion of a signal output from the laser displacement sensor;

a laser emission control circuit configured to control the laser displacement sensor;

a controller configured to acquire, store, and calculate data from the signal conditioning and acquisition circuit via the laser emission control circuit;

wherein the controller is connected to the laser displacement sensor via the signal conditioning and acquisition circuit and via the laser emission control circuit, and wherein the controller is further connected to a memory and a configuration screen; and wherein the memory is configured to store the data, and the configuration screen is configured to receive a command from a user, and display the data acquired by the controller.

2. The device of claim 1, wherein the signal conditioning and acquisition circuit comprises:

a signal amplifier having an input terminal and an output terminal, wherein the input terminal is connected to the laser displacement sensor and the output terminal is connected to a filter;

an analog to digital converter connected the filter and to a logic gate chip, wherein the logic gate chip and the analog to digital converter are connected to the controller.

3. The device of claim 2, wherein the signal conditioning and acquisition circuit further comprises:

a first resistor, a second resistor, a first adjustable resistor, and a second adjustable resistor;

wherein two fixed terminals of the first adjustable resistor are connected to an anode and cathode of a power source, and wherein an adjustment terminal of the power source is connected to the first resistor and the second resistor in series; and wherein a first fixed terminal of the second adjustable resistor is connected to a logic power supply input pin of the analog to digital converter, a second fixed terminal of the second adjustable resistor is connected to a reference voltage output pin of the analog to digital converter, and an adjustment terminal of the analog to digital converter is connected to a reference voltage input pin of the analog to digital converter.

4. A method for detecting compression and reposition performance of a hydraulic buffer for an elevator, comprising:

securing a reflector onto the hydraulic buffer of an elevator, and securing a detection device in close proximity to the hydraulic buffer of the elevator;

activating the detection device, and configuring the detection device to allow a laser beam emitted by a laser displacement sensor to be aligned with a center line of the reflector;

acquiring, via a controller, an initial distance from the laser displacement sensor to the reflector;

short-circuiting electrical switches connected to the hydraulic buffer of the elevator, such that an elevator cage is lowered until the cage stops moving or a wire rope of the elevator slips on a traction wheel, and allowing the cage to move upward to the lowest floor;

acquiring, via the controller, a measurement of distance X from the laser displacement sensor to the reflector at set sampling intervals;

recording data indicating that the hydraulic buffer of the elevator has been repositioned when the difference between the acquired measurements of subsequent intervals falls less than a predetermined amount and the hydraulic buffer has been compressed;

stopping the recording of data, and marking the distance value in the last recorded distance when the difference between the acquired measurements of subsequent intervals is above a predetermined amount;

processing, via the controller, the recorded data, wherein the processing includes searching for a minimum distance from the recorded data, and recording the largest distance between distances measured at subsequent intervals as a maximum compression stroke of the hydraulic buffer;

calculating, via the controller, the minimum distance in the data to the last frame of data, and recording a first slope abrupt-change point in the data as X3, where the moment corresponding to the X3 is a moment point when the buffer begins to reposition; and calculating a reposition time T of the hydraulic buffer for the elevator according to the following formula: T=a time number corresponding to the last recorded distance a time number corresponding to X3) * the sampling interval.

5. The method of claim 4, wherein the recorded data includes distance data and time data, the distance data represents a distance from the laser sensor to the reflector, and the time number data represents a time number corresponding to each distance.

6. The method of claim 4, wherein, in the acquiring, via the controller, a measurement of distance X from the laser displacement sensor to the reflector includes: indicating that the hydraulic buffer for the elevator has been compressed, and allowing the memory starts to continuously store data when the distance that has been detected for three successive times is above the threshold and a compression flag has been detected, and indicating that the hydraulic buffer for the elevator has repositioned completely, and stopping the recording of the data, the distance that has been detected is below the threshold and a reposition flag has been detected.

* * * * *